United States Patent [19]

Klingamon

[11] 4,353,468

[45] Oct. 12, 1982

[54] PORTABLE HAND STAMP STORAGE AND DISPLAY DEVICE

[76] Inventor: Lon C. Klingamon, 1725 Fox Plaza, San Francisco, Calif. 94102

[21] Appl. No.: 119,039

[22] Filed: Feb. 6, 1980

[51] Int. Cl.[3] ..... A47F 5/02

[52] U.S. Cl. ..... 211/39; 211/115; 248/226.5

[58] Field of Search ..... 211/13, 26, 39, 113, 211/115, 69.1, 78; 248/226.5, 205 A, 339, 229, 225.3

[56] References Cited

U.S. PATENT DOCUMENTS

| | | | |
|---|---|---|---|
| 422,056 | 2/1890 | Martin | 211/39 |
| 475,120 | 5/1892 | Klingenberg | 211/39 |
| 643,715 | 2/1900 | Folger | 211/39 |
| 954,793 | 4/1910 | Graham | 211/39 |
| 1,039,634 | 9/1912 | Barnett | 211/39 |
| 1,271,601 | 7/1918 | Meyer | 211/39 |
| 1,952,466 | 3/1934 | Sjodin et al. | 211/113 |
| 2,913,789 | 11/1959 | Loredo | 211/69.1 |
| 3,388,662 | 6/1968 | Raureby | 211/39 |
| 4,140,223 | 2/1979 | Rau et al. | 211/78 |

FOREIGN PATENT DOCUMENTS

| | | | |
|---|---|---|---|
| 25500 | 7/1908 | Sweden | 211/69.1 |

*Primary Examiner*—James A. Leppink
*Attorney, Agent, or Firm*—Paul L. Hickman

[57] ABSTRACT

Disclosed is a low cost, lightweight, portable device for storing and displaying hand stamps by attaching clips to the stamps and then clipping the hand stamps to a vertical lattice. The device can be carried from above or supported from above by a hook in its top, supported on a work surface by an attached flat base plate, or rotatably supported at the side of a work surface by an edge clamp which grips the edge of the work surface.

8 Claims, 1 Drawing Figure

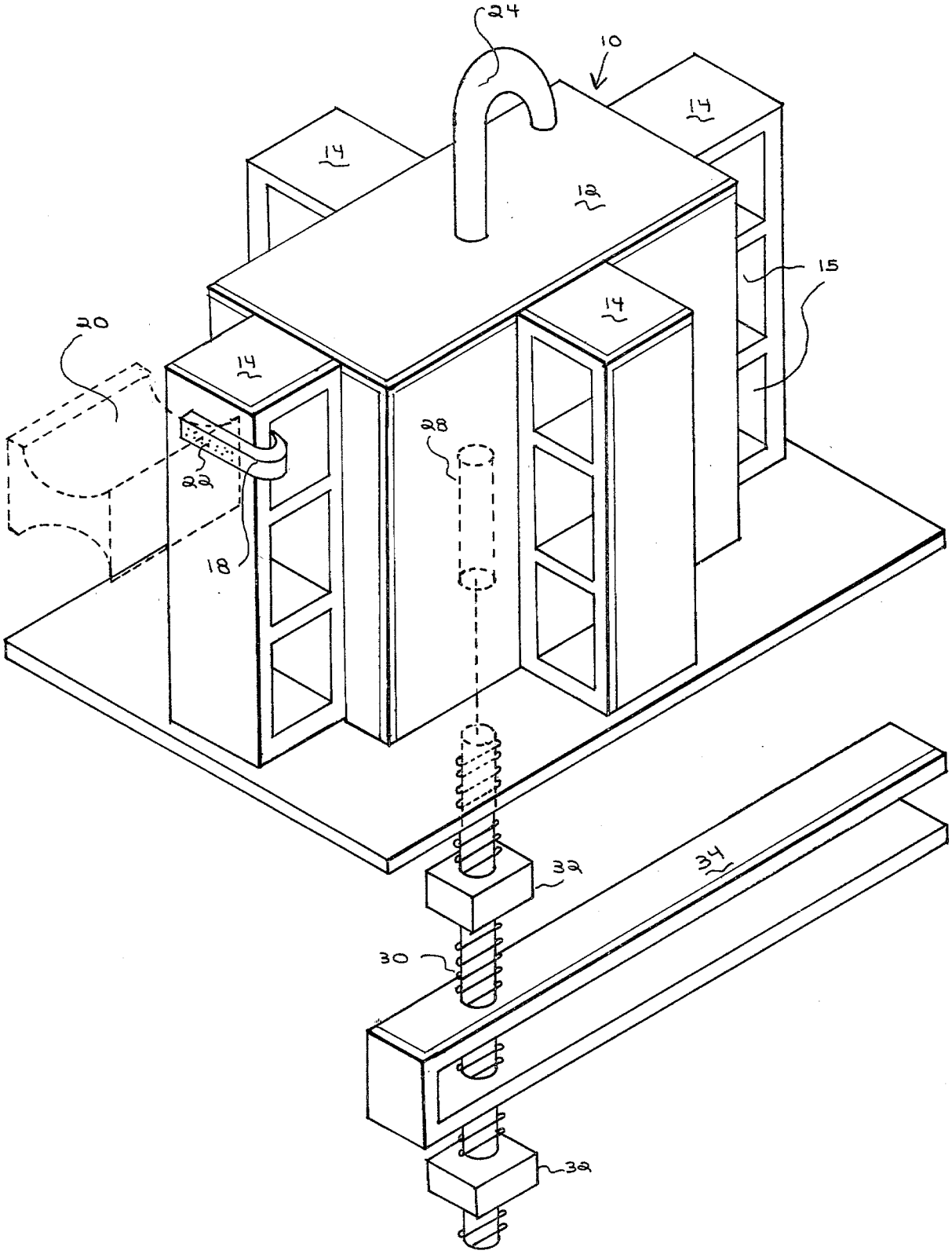
24
10
14
14
12
15
14
20
14
28
22
18
32
34
30
32

PORTABLE HAND STAMP STORAGE AND DISPLAY DEVICE

BACKGROUND OF THE INVENTION

A. Field of the Invention

This invention relates generally to racks and supports and more particularly to a hand stamp rack.

B. Description of the Prior Art

The usefulness of hand stamps in the day to day operation of offices has resulted in a proliferation of such hand stamps and has produced an attendant need to display and store these hand stamps in an orderly and convenient manner. A variety of patents have been issued for such display and storage devices and personal observation of various offices and other work areas shows that some of the inventions patented are indeed in daily use in such work areas. The following paragraphs will discuss the primary two types of patented display and storage devices for hand stamps: wall mounted and surface mounted.

Some representative U.S. Pat. Nos. of the wall mount type include: 316,062; 422,056; 643,715; 807,757; 1,117,364; 3,388,622. While these wall mounted inventions have the advantage of displaying the stamps in such a manner that no work surface area is occupied, these wall mount types are not easily portable (if at all portable), nor are they quickly (if at all) convertible into desk mount types. Some require additional hand stamp identification tags (in addition to those already affixed to the hand stamps) since the labels already affixed to the stamps are not clearly visible when stored on the wall mount racks. It is also noted that the racks appear relatively heavy and that a large amount of rack surface area is generally required for each stamp stored, because of the manner in which the hand stamps are connected to the rack.

Some representative U.S. Pat. Nos. of the desk mount type include 475,120; 563,298; 624,919; 872,446; 954,793; 1,271,601; 1,562,369; and 3,590,734. While these inventions have the advantage of being more portable than the previously discussed wall mount racks, they offer greatly reduced maximum storage capacity, generally more complicated and expensive parts and assembly, generally greater rack weight per number of stamps held, and they are not quickly convertible into wall mount units. In several examples of this type, the inked printing surface comes into contact with a part of the rack, possibly contaminating the printing surface with dirt or with different colored ink from another stamp's having rested there previously.

Extensive personal observation has shown that among the previously issued patents of this type of invention, U.S. Pat. No. 152,369 of A. W. Schmidt and several adaptations thereof (particularly the stacking of individual clip members in a multi-tiered carousel fashion) seem to enjoy the widest use in offices, and so, this patented invention is worthy of special discussion. The metal construction of this popular "carousel" multi-tiered model makes it durable, but also relatively heavy. Although its actual base is not large, the lowermost tier of the carousel is quite large in radius and almost completely precludes use of the desk space underneath the lowermost tier. As patented, there is no provision for a mounting which will occupy zero desk space. Only 25% of the stamp labels are visible from a seated position with the carousel model, viewing 25% more labels requires a full 180° rotation and the remaining 50% of the labels are only visible by rising from a seated position and turning additional rotations of up to 180°. Finally, in its largest currently available capacity, the carousel can hold a maximum of only 40 handstamps in a vertical space of approximately 18 inches.

In short, an examination of the prior art reveals a collection of patented inventions which share one or more of the following limitations:

(1) Relatively great weight
(2) Limited portability
(3) No flexibility for mode change (ie, from desk mount to wall mount and vice versa)
(4) Complicated and/or expensive components and/or assembly
(5) Large surface area and/or weight per hand stamp held
(6) Small maximum stamp holding capacity
(7) Poor hand stamp label visibility

SUMMARY OF THE INVENTION

One objective of this invention is to provide a portable, lightweight device for carrying, displaying, and storing hand stamps.

Another objective is to provide such a device that can be quickly converted from a desk mount model to a wall mount model and vice versa as the need arises. A third model attaches to an edge of a desk so that it is easy to use from a seated desk position, but that so that it takes no desk space.

Another objective is to provide such a device at low cost that is constructed of inexpensive components and is easily and inexpensively assembled.

Another objective is to provide such a device which will offer a greater storage capacity than the models of comparable size currently available, while allowing an improved visibility of the stored hand stamps' labels.

Briefly, this invention includes a support member attached to rectangular lattices which define a number of square holes and a number of two-legged clips which are removably engageable with the holes of the lattices. Hand stamps are attached to respective clips so that the clip-hand stamp combination then becomes removably engageable with the lattices. This invention further includes a flat base plate, attached to the bottom of the support member, and an edge clamp, rotatably and removably attached to the base plate. When the clamp is attached to the edge of a work surface, the remainder of the device is free to rotate, allowing a user access to a hand stamp attached to any lattice. Some embodiments of this invention include a hook attached at the uppermost portion of the support member.

One advantage of the invention is its light weight and portability, due, in part, to its efficient design and due, in part to the fact that it is well suited for construction from lightweight materials such as injected plastics, particleboard, and Masonite.

A second advantage of the invention is its versatility, or variety of use modes. This one invention is quickly changeable from a desk mount unit to a wall mount unit. A third variation, the edge clamp mount mode, allows its use essentially as a desk mount unit, without the device's occupying any desk space.

Another material advantage of the invention is that it is constructed of simple and inexpensive components and that it is easily assembled.

Another material advantage of the invention is that storage capacity is increased while visibility of the hand stamp labels is maintained. The invention as described could hold approximately 72 one-inch thick hand stamps in a vertical space of 18 inches.

These and other objects and advantages of the present invention will no doubt become apparent after a reading of the following descriptions and a study of the drawing.

BRIEF DESCRIPTION OF THE DRAWING

The sole FIGURE is a perspective view of an improved portable hand stamp storage and display device in accordance with the present invention.

DETAILED DESCRIPTION OF THE PREFERRED EMBODIMENT

In FIG. 1, an improved portable device 10 for displaying and storing hand stamps in accordance with the present invention is shown to include a support member 12 to which are attached four radially outwardly extending lattices 14, which define a number of apertures 15. Removably attached to one of the lattices is a clip 18 which is attached to a hand stamp 20, by an adhesive 22 or other suitable attachment device. A hook 24 is attached to the top of the support member and a base plate 26 is attached to the bottom of the support member. A bore 28 is formed through the base plate and extends into the support member as shown.

A threaded rod 30, a pair of tightening nuts 32 and a "U"-shaped jaw piece 34 comprise a preferred type of work surface edge clamp. In use, the upper end of rod 30 extends into bore 28 and provides a rotational axis for the device. Nuts 32 are tightened down onto jaw piece 34 to firmly clamp it to a work surface edge.

Portable device 10 was designed with a view to having a handicapped workshop assemble it from its components. In its complete preferred embodiment, the lattices would be glued to the support member and the base plate glued to the lattice-support member combination at its bottom. The bore 28 would then be made in the base plate and finally, the hook would be screwed into its top.

In its preferred composition, support member 12 will be made from recycled particleboard, the preferred material because it is inexpensive and easy to work with. The preferred embodiment of support member 12 is shown as a rectangular solid having four vertical faces to which lattices are attached. Alternate embodiments could have from one to three vertical faces or more than four vertical faces.

Hook 24 is a stock item currently commercially available. It need not be excessively strong as it will not be supporting much weight when utilized. In the preferred embodiment, the hook has a threaded and pointed straight shaft for screwing into the top of the support member, although alternate embodiments may have hooks which are simply pounded into place or glued into place.

Base plate 24, which provides supplementary stability for the lattice-support member combination, is constructed from Masonite in the preferred embodiment, but alternate constructions could be of plastic or thin construction grade plywood.

Lattices 14 can be made of any number of commercially available durable plastics. In the preferred embodiment, the lattice has all plastic walls defining the square apertures. An alternate embodiment would have the plastic lattice wall which ordinarily touches the support member removed and the "open" lattice would then be attached to the support member so that the vertical face of the support member would then become one wall of each of the square apertures. It is also apparent that an alternate embodiment of this invention would use either more or less than four lattices of either type just discussed.

Clips 18 are also currently available in such forms as the plastic clips which are used to secure newly manufactured mens' trousers for shipment and this type of clip is shown in the preferred embodiment. Once again, extreme strength is not necessary for these clips since the hand stamps themselves are not heavy and also since the horizontal members of the lattice will also provide some support for the weight of the hand stamp. The clip's main purpose is to prevent the movement of the hand stamp in a plane parallel to the work surface being used, when the hand stamp is stored.

Adhesive 22 as shown in the preferred embodiment is one of the "Super Glue" variety of high strength adhesives, although since the hand stamp itself is not heavy, a lesser-strength adhesive may prove effective as an alternate embodiment.

Three components of the preferred embodiment of the work surface edge clamp, the threaded rod 30 and the tightening nuts 32 are currently available commercially. An alternate embodiment of this edge clamp could use a threaded bolt, a wing nut, and a washer, along with the same "U"-shaped jaw piece. The wing nut would be tightened on the threaded bolt to bring the jaws of the jaw piece together to grip the surface, and the washer would then be placed around the threaded bolt and on top of the wing nut to provide a smooth surface for the portable device to rotate on, if necessary. The final component of the work surface edge clamp, the "U"-shaped jaw piece, if not currently commercially available, could be fabricated from aluminum flat bar, as shown in the preferred embodiment. An alternate embodiment would be made of injected plastic or other material of suitable strength and low cost.

In use, the device converts among three use modes: off-desk mount, desk mount, and wall mount. The most useful mode will probably be the off-desk mount, in which the device rotates on the threaded rod of the work surface edge clamp. To convert from off-desk mount to desk mount, one lifts the device off the threaded rod using the hook and then places it on the appropriate work surface, with the flat base plate actually resting on that surface and helping to hold the lattice-support member combination in a vertical attitude. In actuality, it is thought that the additional balancing and support function of the base plate will only be required when there is a large number of stamps attached to the lattices. In most other cases, the bases of the outwardly radiating lattices themselves would provide enough balancing and support. Thus, an alternate embodiment would be one with no base plate.

To convert from desk mount to wall mount, one again lifts the device by the hook and then hangs the device by the hook on any appropriate horizontal member, such as one which might extend from a pegboard rack mounted on a wall, or such as a nail of appropriate length which might extend from a wall. In the wall mount mode, it must be said that there is an almost negligible decrease in the ease of view of the hand stamps' labels as follows: when hung from such a horizontal member, 50% of the hand stamp labels will still be visible from a position directly in front of the device, as is the case in the desk mount and off-desk mount modes. Since a 90° rotation as is normally required to bring the remaining 50% into view is not quite possible due to the interation of the hook and the horizontal member, the user will have to lean slightly to his left or right in conjunction with the restricted rotation in order to view the remaining labels.

A variety of other sequences of mode changes is possible by varying the foregoing sequence of actions.

It is contemplated that those reading the preceding descriptions and studying the accompanying drawing will realize various modifications, alterations, and permutations of the present invention. For example, it would be possible to construct the support member with fewer than four vertical faces or more than four such faces. Furthermore, the clips could be tacked to the handstamps rather than glued.

It is therefore intended that all the following apended claims be interpreted as including all such modifications, alterations, and permutations as fall within the true spirit and scope of the present invention.

What is claimed is:

1. A portable storage and display device for at least one hand stamp comprising:

(a) a support member;

(b) at least one elongated, rectangular prism shaped lattice member provided with a plurality of spaced apart, rectangular apertures, said lattice member being attached to said support member such that said apertures are substantially unobstructed;

(c) clip means removably engagable with said lattice member, whereby at least a portion of said clip means extends within one of said apertures;

(d) means for attaching a hand stamp to said clip means; and (e) base means including a U-shaped jaw piece, an elongated, at least partially threaded rod extending through said jaw piece and having an upper end rotatably engaging a bore provided in said support member, and a pair of nuts engaged with said threaded rod for urging the jaws of said jaw piece together.

2. A portable storage and display device for at least one hand stamp comprising:

(a) a support member provided with a bore extending into a lower surface thereof;

(b) at least one elongated lattice member provided with a plurality of spaced apart apertures, said lattice member being attached to said support member such that said apertures are substantially unobstructed;

(c) clip means removably engagable with said lattice member, whereby at least a portion of said clip means extends within one of said apertures;

(d) means for attaching a hand stamp to said clip means; and (e) base means including a U-shaped jaw piece, an elongated rod coupled to said jaw piece and having an upper end removably engaging said bore provided in said support member, and means urging the jaws of said jaw piece together to clamp to a support surface.

3. A portable storage and display device as recited in claim 2 wherein said elongated rod is at least partially threaded, and wherein said base means further includes at least one nut engaged with said threaded rod for urging said jaws of said jaw piece together.

4. A portable storage and display device as claimed in claim 2 wherein the jaws of said U-shaped jaw piece are biased toward each other.

5. A portable storage and display device as claimed in claim 2, wherein said base further comprises:

a flat base plate permanently affixed to said support member.

6. A portable storage and display device as claimed in claim 2 wherein said clip means is substantially "U"-shaped and has a first and a second leg portion, said leg portions being biased toward each other, wherein said "U"-shaped clip means straddles the edge wall of one of said apertures.

7. A portable storage and display device as claimed in claim 6 wherein said attachment means further comprises an adhesive substance of sufficient strength so as to permanently bond said hand stamp to an exposed surface of said clip means whereby said hand stamp combination becomes removably couplable with said lattice means.

8. A portable storage and display device as claimed in claim 2, said support member further comprising a hook means attached to said support member.

* * * * *